United States Patent [19]

Kurahashi

[11] 4,054,215

[45] Oct. 18, 1977

[54] ARTICLE DELIVERY AND UNLOADING DEVICE

[76] Inventor: Yutaka Kurahashi, c/o Tokyo First Factory, Ishikawajima, Harima Jukogyo Kabushiki Kaisha, 1-1, 2-chome, Tsukuda, Chuo, Tokyo, Japan

[21] Appl. No.: 649,121

[22] Filed: Jan. 14, 1976

[30] Foreign Application Priority Data

Jan. 14, 1975 Japan ..... 50-6731[U]

[51] Int. Cl.[2] ..... B65G 47/38

[52] U.S. Cl. ..... 214/58; 104/166

[58] Field of Search ..... 214/59 R, 59 A, 60, 214/61, 58; 104/166; 105/241 R, 241 C

[56] References Cited

U.S. PATENT DOCUMENTS

| | | | |
|---|---|---|---|
| 1,333,947 | 3/1920 | Travell | 214/60 |
| 1,368,289 | 2/1921 | Post | 214/59 R |
| 1,774,863 | 9/1930 | Young | 214/59 X |
| 2,290,844 | 7/1942 | Smith | 214/58 X |
| 2,928,359 | 3/1960 | Vogel | 214/59 R X |
| 3,118,393 | 1/1964 | Ohlin | 104/166 |
| 3,897,735 | 8/1975 | Watts | 104/166 |

*Primary Examiner*—Albert J. Makay
*Attorney, Agent, or Firm*—Seidel, Gonda & Goldhammer

[57] ABSTRACT

A vehicle adapted to be conveyed along a track has an inclined upper platform for supporting an article thereon. A gate hinged to the lower end of the platform is maintained in an upright position by a rotatable lever thereby preventing the article from sliding off of the vehicle. As the vehicle approaches an unloading chute, the lever is rotated to an inoperative position allowing the gate to open and the article to slide off the vehicle into the chute.

14 Claims, 3 Drawing Figures

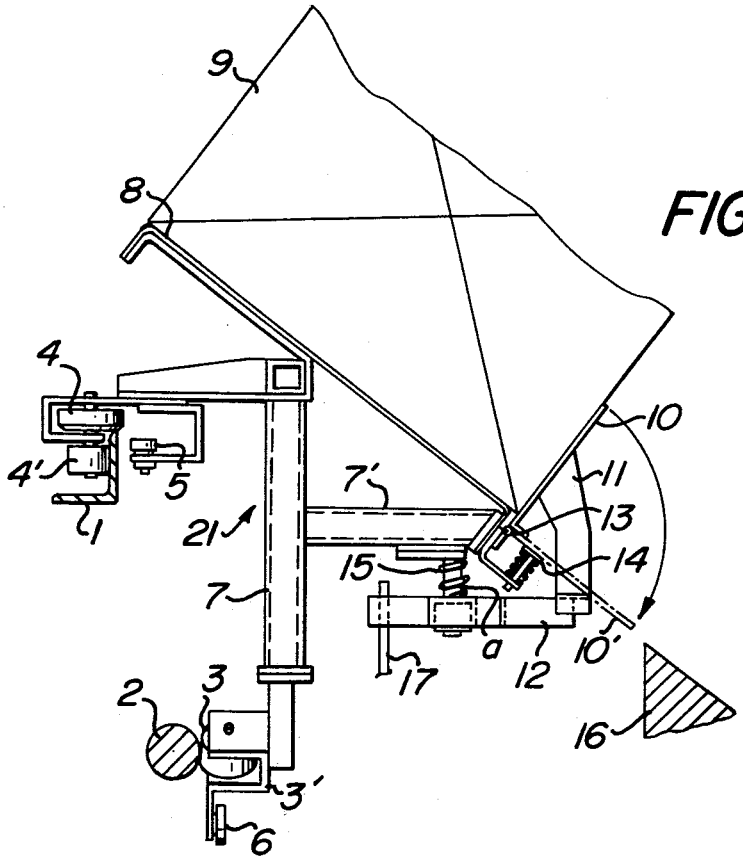
FIG. 1
FIG. 2
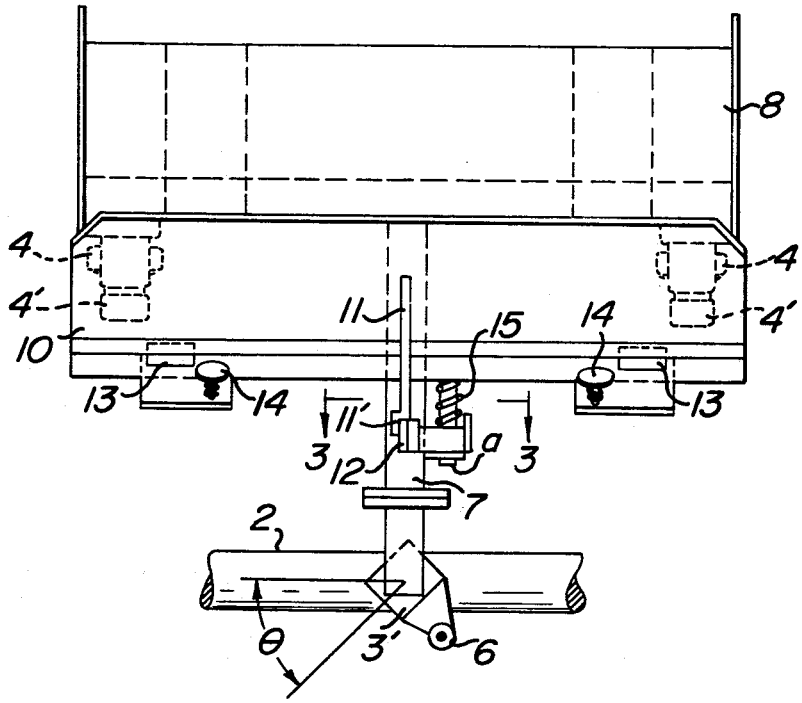
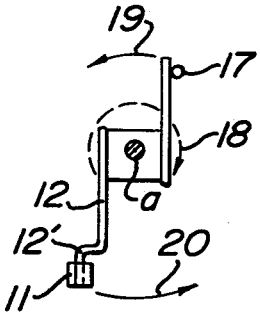
FIG. 3

ARTICLE DELIVERY AND UNLOADING DEVICE

Background

The subject matter of the present invention relates to a vehicle and/or system of the type disclosed in U.S. Pat. Nos. 3,903,810; 3,118,393; and 3,356,040.

The present invention is an improvement on the type of vehicle and the type of unloading device for unloading articles from the vehicle.

This invention is directed to an article delivery and unloading device and more particularly to a system which conveys and automatically unloads articles. The system may employ a plurality of vehicles which convey articles and selectively deliver them to different unloading chutes.

Each vehicle is adapted to support and deliver an article and is mounted for movement along a conveyor line. The vehicle has a wheel for rolling contact with a stationary track and a drive wheel for frictional contact with a rotating shaft. A means is provided to bias the drive wheel so that its axis of rotation is angled with respect to the longitudinal axis of the rotating shaft.

Each vehicle includes an inclined upper platform which acts as a support for an article being carried thereon. A gate hinged to the lower end of the platform is maintained in an upright position by a rotatable lever thereby preventing the article from sliding off of the vehicle. As the vehicle approaches an unloading chute, the lever is rotated to an inoperative position allowing the gate to open and the article to slide off of the vehicle into the chute.

For the purpose of illustrating the invention, there is shown in the drawings a form which is presently preferred; it being understood, however, that this invention is not limited to the precise arrangements and instrumentalities shown.

FIG. 1 is a cross sectional view of a vehicle and track system constructed in accordance with the principles of the present invention.

FIG. 2 is a side plan view of the vehicle and track shown in FIG. 1.

FIG. 3 is a cross sectional view taken along the lines 3—3 in FIG. 2.

Referring to the drawing in detail, wherein like numerals indicate like elements, there is shown a preferred embodiment of the present invention. The system includes a conveyor line having a rail 1, only a portion of which is shown in FIG. 1. A drive shaft 2 is disposed parallel to and below rail 1. Drive shaft 2 is supported by suitable spaced bearings and rotates about its longitudinal axis.

A vehicle designated generally as 21 is adapted to be conveyed along the conveyor line and includes a drive wheel 3 which is in frictional contact with the drive shaft 2. The vehicle 21 applies a force to the drive wheel 3 against drive shaft 2 which is a result of the eccentric moment created by the weight of the vehicle 21 and any articles 9 supported thereby. When the friction between the drive wheel 3 and the drive shaft 2 is at a certain angle, and with the drive shaft 2 rotating, an effect is attained in the same manner as a screw effect with the result that the vehicle 21 is moved forward or backward.

The vehicle 21 also includes a plurality of driven wheels 4, 4' and 5 which are rotatably supported on a main vehicle frame 7. The driven wheel 4 rotates at its periphery on the top edge of track 1. Driven wheel 4' is in rolling contact with the left vertical surface of the track 1 so as to prevent the vehicle 21 from rotating off the track by rotation in a clockwise direction as viewed in FIG. 1. Wheel 5 functions as a guide roller and is normally inoperative. However, if for some reason the vehicle 21 is moved to the left as viewed in FIG. 1 wheel 5 will contact the vertical right side of track 1 thereby preventing the vehicle from derailing.

The drive wheel 3 is supported by a bracket 3' which in turn is rotatably supported by the main vehicle frame 7. Bracket 3' also supports a sensor roller 6 at its lower end. Sensor roller 6 is adapted, when contacting a fixed object along the conveyor line, to rotate bracket 3 to thereby change the angle $\theta$ between the axis of rotation of drive wheel 3 and the longitudinal axis of drive shaft 2. A spring, not shown, biases the drive wheel 3 to the drive position shown in FIGS. 1 and 2.

The vehicle frame 7 also includes a horizontally extending portion 7'. An article supporting platform 8 extends between the vehicle frame portions 7 and 7' and is adapted to support an article 9 thereon. As shown best in FIG. 1, platform 8 is inclined with respect to the horizontal such that article 9 tends to slide downwardly and to the right as viewed in FIG. 1.

A gate 10 is hinged by a plurality of hinges 13 to the lower end of the platform 8. The upper end of a locking member 11 is rigidly secured to gate 10 and is adapted to move in unison with gate 10. The lower end of locking member 11 is crank-shaped and has a downwardly facing surface 11' which rests on one end 12' of a crank-shaped lever 12. Lever 12 is mounted on the lower portion of horizontal frame member 7' and is rotatable about a shaft *a*. A torsion spring 15 biases lever 12 in a clockwise direction as shown by the arrow 18 in FIG. 3. As a result, the forward end 12' of lever 12 is forced against the lower end of locking member 11. And since the surface 11' of locking member 11 rests on lever 12, gate 10 is held in its upright or closed position. As will be described more fully hereinafter, when the other end of lever 12 engages a fixed stop element 17, the lever is forced to rotate counterclockwise in the direction of arrows 19 and 20 in FIG. 3. As lever 12 rotates, the forward end 12' disengages from the lower end of locking member 11 thus allowing gate 10 to move downwardly into its open position. Gate stop members 14 prevent gate 10 from opening passed the position wherein it is aligned with platform 8 as shown in FIG. 1. With gate 10 open, the article 9 slides downwardly off platform 8 and into the chute 16.

The above-described device operates as follows. The eccentric moment about the contact point of the driven wheel 4 and the rail 1 and caused by the weight of the vehicle 21 and article 9 forces drive wheel 3 into contact with drive shaft 2. The interaction between drive shaft 2 and drive wheel 3 has a screw effect causing the vehicle to be propelled. The running speed of the vehicle depends on the angle $\theta$ between the axis of drive wheel 3 and the axis of drive shaft 2. This may be changed by sensor roller 6 engaging a fixed element preferrably having an increasing gradient. As a result, the vehicle can be automatically slowed down as it approaches a discharge chute 16. Similarly, by reducing the gradient in the other direction the vehicle automatically accelerates after it passes the discharge chute 16.

Since the platform 8 is inclined, the article 9 being carried thereon is allowed to fall by gravitational force. However, before the vehicle arrives at the prescribed position opposite chute 16, the locking member 11 secured to the gate 10 is engaged by the lever 12 thereby maintaining the gate 10 in its upright closed position. As the vehicle 21 approaches the discharge chute 16, the inner end of lever 12 engages the upwardly extending stop member 17 and since the vehicle continues to move, lever 12 rotates against the force of spring 15. This movement of lever 12 releases the locking member 11 and gate 10 opens to the open position 10' as shown in dotted lines in FIG. 1. With gate 10 open, article 9 is now free to move downwardly off platform 8 and into chute 16.

It should be readily apparent that the present invention can also be used to selectively deliver different articles to different unloading chutes. This can be easily accomplished by varying the length of the end of lever 12 which is adapted to strike stop element 17 and/or by changing the position of stop element 17 relative to the conveyor line. In this way, vehicles with short levers 12 will pass certain unloading stations without unloading their articles and will only unload at stations where the stop element 17 is close enough to the axis *a* for lever 12 to strike the same.

While not specifically shown, after the gate 10 is opened and the vehicle passes the unloading station, the gate can be re-closed by an inclined guide located along the conveyor line. Once the gate 10 is guided into its upward position spring 15 will automatically rotate lever 12 so as to again engage the bottom of locking member 11. Thus, it can be seen that all of the forces required to open and close gate 10 and to therefore unload articles 9 are derived from the movement of vehicle 21. As a result, no external forces such as electrical power is needed to unload articles from the vehicles. In addition, since the platform 8 is always in an inclined condition, the articles are immediately discharged from the vehicles at the discharge stations and it is not necessary to wait for the vehicle or platform 8 to be moved into an inclined position.

The present invention may be embodied in other specific forms without departing from the spirit or essential attributes thereof and, accordingly, reference should be made to the appended claims, rather than to the foregoing specification as indicating the scope of the invention.

I claim:

1. Apparatus comprising:

a conveyor line;

at least one unloading station positioned adjacent to said conveyor line;

a stop means positioned along said conveyor line adjacent said unloading station;

at least one vehicle supported by said conveyor line for movement along said conveyor line;

said vehicle including an inclined article supporting platform and a means for preventing an article from sliding off of said platform;

an actuator means mounted on said vehicle;

said preventing means including a gate means hinged to said vehicle adjacent the lower end of said inclined article supporting platform and an arm extending generally outwardly from said gate means and having an end with a generally horizontal surface supported by said actuator means;

said actuator means cooperating with said stop means when said vehicle is adjacent said unloading station for deactuating said preventing means whereby an article is allowed to slide off of said platform; and said actuator means includes a generally horizontally disposed lever means rotating about a generally vertical axis having a first end adapted to support said arm and another portion being adapted to cooperate with said stop means.

2. Apparatus in accordance with claim 1 wherein said conveyor line is a single track and has a horizontally disposed drive shaft, said drive shaft being rotatable about its longitudinal axis and being supported below said single track.

3. Apparatus in accordance with claim 2 wherein said vehicle includes a wheel for rolling contact with said track and a drive wheel for frictional contact with said shaft.

4. A driverless wheeled vehicle adapted to be conveyed along a single track conveyor comprising:

a vehicle frame means;

at least one carrier wheel supported by said frame means and adapted for rolling contact with said single track;

a drive wheel supported by said frame means below said carrier wheel and adapted to be driven by a drive means carried by said conveyor for driving said frame means along said track;

an inclined platform means mounted on said frame means and being adapted to carry an article thereon;

means associated with said platform means for preventing said article from slipping off of said platform, and an actuator means for selectively de-activating said preventing means whereby said article is allowed to slide off of said platform.

5. A vehicle in accordance with claim 4 wherein said preventing means includes a gate means hinged to said platform means at the lower end thereof, said gate means being movable between a closed position and an open position.

6. A vehicle in accordance with claim 5 further including gate stop means for preventing said gate means from opening past a position wherein said gate means is in substantial alignment with said inclined platform means.

7. A vehicle in accordance with claim 5 wherein said actuator means includes a generally horizontal lever rotatably mounted on said frame means for rotary motion about a generally vertical axis and having a portion adapted to cooperate with said gate means;

8. A vehicle in accordance with claim 7 wherein said gate means includes a gate and a locking member rigidly secured and depending from said gate.

9. A vehicle in accordance with claim 8 wherein said one end of said lever cooperates with said locking member and including means for biasing said one end of said lever towards said locking member.

10. Apparatus in accordance with claim 2 wherein said track includes a generally horizontal member interconnected with a generally vertical member.

11. Apparatus in accordance with claim 10 wherein said vehicle includes a first wheel for rolling contact with an upper horizontal surface of said vertical member and a second wheel for rolling contact with a vertical surface of said vertical member.

12. Apparatus in accordance with claim 11 wherein said first and second wheels are rotatable about a single vertical axis.

13. Apparatus in accordance with claim 1 including means for biasing said lever means to a position in contact with said arm.

14. Apparatus comprising:

a conveyor line having only a single track;

a longitudinally extending drive shaft supported below and extending along with said track;

said drive shaft being rotatable about its longitudinal axis;

a driverless vehicle having a frame means;

a pair of wheels supported for rotary motion by said frame;

one of said wheels being in rolling contact with the top horizontal surface of said track and the other of said wheels being in rolling contact with a vertical surface of said track;

a drive wheel rotatably mounted to said frame and adapted to be in driving contact with said drive shaft;

an inclined platform means mounted on said frame means and being adapted to carry an article thereon;

gate means hinged to said vehicle adjacent the lower end of said inclined article supporting platform for preventing an article from sliding off of said platform with said gate means in an upright position;

at least one unloading station positioned adjacent said conveyor line; and means positioned adjacent said unloading station for moving said gate means from said upright position to a position wherein articles carried on said platform are free to slide from said platform onto said unloading station.

* * * * *